US006182999B1

(12) United States Patent
Bourdeau

(10) Patent No.: US 6,182,999 B1
(45) **Date of Patent: *Feb. 6, 2001**

(54) RETENTION APPARATUS FOR A BOOT ON A GLIDING BOARD

(75) Inventor: Joël Bourdeau, Saint-Jorioz (FR)

(73) Assignee: Salomon S.A., Metz-Tessy (FR)

( * ) Notice: Under 35 U.S.C. 154(b), the term of this patent shall be extended for 0 days.

This patent is subject to a terminal disclaimer.

(21) Appl. No.: 09/237,857

(22) Filed: Jan. 27, 1999

Related U.S. Application Data

(63) Continuation of application No. 08/757,285, filed on Nov. 27, 1996, now Pat. No. 5,938,228, which is a continuation of application No. 08/224,142, filed on Apr. 4, 1994, now Pat. No. 5,595,396.

(30) Foreign Application Priority Data

May 14, 1993 (FR) ..... 93 06006

(51) Int. Cl.[7] ..... A63C 9/18

(52) U.S. Cl. ..... 280/607; 280/14.2; 280/613; 280/615

(58) Field of Search ..... 280/607, 613, 280/614, 615, 632, 623, 624, 634, 627; 36/115, 117.1, 89, 88, 118.2

(56) References Cited

U.S. PATENT DOCUMENTS

| | | | |
|---|---|---|---|
| 2,693,967 | 11/1954 | Jones, Jr. | 280/613 |
| 3,061,325 | 10/1962 | Glass | 280/613 |
| 3,902,729 | 9/1975 | Druss | 280/613 |
| 3,957,280 | 5/1976 | Turnheim et al. | 280/613 |
| 4,021,056 | 5/1977 | Oakes | 280/613 |
| 4,191,395 | 3/1980 | Salomon | 280/613 |
| 4,768,804 | 9/1988 | With | 280/614 |
| 4,836,572 | 6/1989 | Pozzobon | 280/613 |
| 4,842,293 | 6/1989 | Rochard | 280/607 X |
| 4,923,207 | 5/1990 | Pozzobon | 280/613 |
| 4,973,073 | 11/1990 | Raines et al. | 280/14.2 |
| 5,035,443 | 7/1991 | Kincheloe | 280/14.2 |
| 5,064,214 | 11/1991 | Diard et al. | 280/607 |
| 5,190,310 | 3/1993 | Hauglin et al. | 280/615 |
| 5,224,730 | 7/1993 | Provence et al. | 280/615 |
| 5,505,477 | 4/1996 | Turner et al. | 280/613 |
| 5,520,406 | 5/1996 | Anderson et al. | 280/624 |
| 5,595,396 | 1/1997 | Bourdeau | 280/607 |

FOREIGN PATENT DOCUMENTS

| | | |
|---|---|---|
| 9200453 | 4/1992 | (DE) . |
| 0396133 | 11/1990 | (EP) . |
| 0551899 | 7/1993 | (EP) . |
| 2592807 | 7/1987 | (FR) . |
| 2631844 | 12/1989 | (FR) . |
| 2641703 | 7/1990 | (FR) . |
| 2669237 | 5/1992 | (FR) . |
| WO91/11232 | 8/1991 | (WO) . |

*Primary Examiner*—Brian L. Johnson
*Assistant Examiner*—Avraham H. Lerner
(74) *Attorney, Agent, or Firm*—Greenblum & Bernstein, P.L.C.

(57) ABSTRACT

A retention or binding apparatus for a boot on a gliding board, especially a snowboard. The apparatus includes a retention element associated with the board, cooperating with a complementary retention element associated with the boot, together ensuring a connection between the boot and the board according to different degrees of freedom. The apparatus includes a groove for one of the elements, and a rib for the other element. The rib and the groove having complementary shapes to enable cooperation by nesting. The apparatus also includes a gripping mechanism for one of the elements and a latching mechanism for the other element, forming a removable latch for actively retaining the rib nested in the groove.

7 Claims, 7 Drawing Sheets

11
25
15
23
28
25
19
22
20
10
21
30
31
12
17
13
18
35

RETENTION APPARATUS FOR A BOOT ON A GLIDING BOARD

CROSS-REFERENCE TO RELATED APPLICATIONS

This application is a continuation of application Ser. No. 08/757,285, filed on Nov. 27, 1996 now U.S. Pat. No. 5,938,228 issued Aug. 17, 1999, which is a continuation of application Ser. No. 08/224,142, filed on Apr. 4, 1994, now U.S. Pat. No. 5,595,396, issued on Jan. 21, 1997. The disclosures of both of the aforementioned applications are hereby incorporated by reference thereto in their entireties and the priorities of both are claimed under 35 USC 120.

This application is also based upon French application No. 93.06006, filed on May 14, 1993, the priority of which is hereby claimed under 35 USC 119.

BACKGROUND OF THE INVENTION

1. Field of the Invention

The invention is directed to a retention device for a boot on a gliding board, especially on a snowboard.

The invention is also directed to a boot for gliding, especially snowboarding, and a gliding board, especially for snowboarding.

2. Description of Background and Relevant Information

Snowboarding is a gliding sport which is practiced by means of a board in the form of a plate, of which the front end is raised to form the shovel. Certain boards also have the rear end raised. The skier is connected to the board by means of two retention elements which hold each of his or her boots. The retention elements are generally offset along the median longitudinal axis of the plate, and they form, with this axis, an angle of 5 to 90° from one or the other side of this axis. This angle as well as the distance between the two retention elements can be adjustable.

There are two large families of boot retention elements on the board, depending on whether the boots are of the rigid or the flexible type. For boots of the rigid type, the retention elements generally comprise a plate on which the sole of the boot is in support. At each end of the plate, the boot is held by a stirrup which takes support on the front or rear tip of the boot.

Such a device is known, for example, from French Patent Publication No. 2 669 237.

Another device of this type is known from European Patent Publication No. 0 396 133. This device additionally comprises an intermediary plate which is connected to the gliding board by a linkage of the releasable type. However, the boot is held on the plate by means of conventional stirrups.

A retention device is also disclosed in French Patent Publication No. 2 592 807, for example, for flexible type boots, i.e., shoes which resemble boots. These binding elements generally comprise a rigid shell which is assembled at the surface of the gliding board and inside of which the boot is inserted and retained.

The currently known retention elements have the disadvantage of being cumbersome, either in terms of length of the boot or in terms of height. In addition, besides the orientation adjustment of the boots with respect to the longitudinal direction of the plate, they require adaptation adjustments to the boot of the rider/snowboarder, mainly to its length. Further, currently known retention elements occupy a substantial surface of the board, and therefore disturb its flexion and/or torsion during the glide.

SUMMARY OF THE INVENTION

An object of the present invention is to propose a retention device for a boot on a gliding board which is less cumbersome.

Another object of the invention is to propose a retention device for the board which ensures good transmission of the forces that the skier produces during the glide.

Another object of the invention is to propose a retention device whose construction is particularly simple.

Another object of the invention is to propose a retention device which can be adapted to boots of different length and volume without special adjustment.

Other objects and advantages of the invention will become apparent upon reading the following description, this description being given as a non-limiting guide.

The retention device for a boot on a gliding board according to the invention comprises a retention element associated with the board cooperating with a complementary retention element associated with the boot, the assembly ensuring a linkage between the boot and the board according to the different degrees of freedom of movement of the boot with respect to the board.

The invention includes a structural arrangement that defines a groove for one of the elements and another structural arrangement defining a rib for the other element, the rib and the groove have complementary shapes in order to cooperate by nesting. The invention also includes an attachment mechanism for one of the elements, and for the other, a retention mechanism forming a removable latch to actively retain the rib nested into the groove at least along the nesting direction. The invention further includes a control arrangement to at least open the latch voluntarily.

BRIEF DESCRIPTION OF THE DRAWINGS

The invention will be better understood by referring to the description below, as well as to the annexed drawings, which are an integral part thereof, and in which.

DETAILED DESCRIPTION OF THE INVENTION

Figure 1:
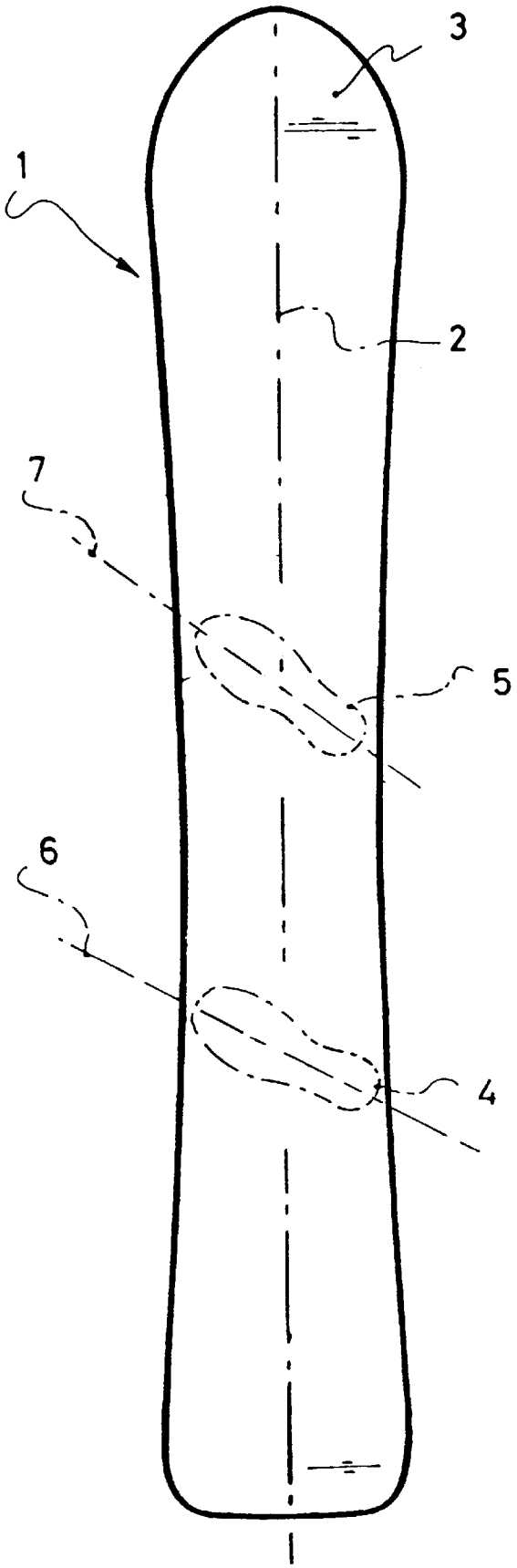
FIG. 1 schematically represents a bottom view of a gliding board such as a snowboard.

In FIG. 1, a snowboard 1 is schematically represented in a top view. The board is in the form of a plate elongated along a median longitudinal direction 2. The lateral edges of the board are most often incurved according to what is commonly known as dimension lines.

Generally, the front end 3 of the board is raised to form the shovel. The rear end can also be raised, according to the nature of the gliding discipline which is practiced.

The rider/snowboarder is connected to the board 1 by means of both his/her boots which are held at the upper surface of the board by retention devices. Usually, the boots of the rider/snowboarder are retained next to one another along the median longitudinal direction 2, in the central zone of the board, at a distance of approximately 45 centimeters (cm) apart. Their position is schematically represented and identified by reference numerals 4 and 5. Both boots are oriented respectively along directions 6 and 7 which are oriented obliquely with respect to direction 2. The angles of orientation vary as the case may be between 90 and 5 degrees from either side of the longitudinal direction depending upon whether the rider/snowboarder is of a "goofy" or "regular" nature. In general, these angles are adjustable. The spacing of the boots can also be adjustable. The width of the board in the central zone is close to or less than the length of the boot.

The foregoing description is only given as a guide and not as a limiting value for the invention. Indeed, there are a number of embodiments of such a gliding board, in particular numerous different forms, symmetrical or asymmetrical, adapted especially to the build of the rider/snowboarder and to the gliding discipline practiced.

According to the invention, each boot is retained on the board by a retention or binding apparatus. The apparatus includes an element associated with the boot and an element associated with the board. One of the elements has a means forming a rib, the other device has a means forming a groove. The rib and the groove sectionally have complementary shapes for nesting in one another. Preferably, these shapes ensure an automatic taking up of play. The device additionally comprises a latching mechanism for retaining the rib nested in the groove.

Figure 2:
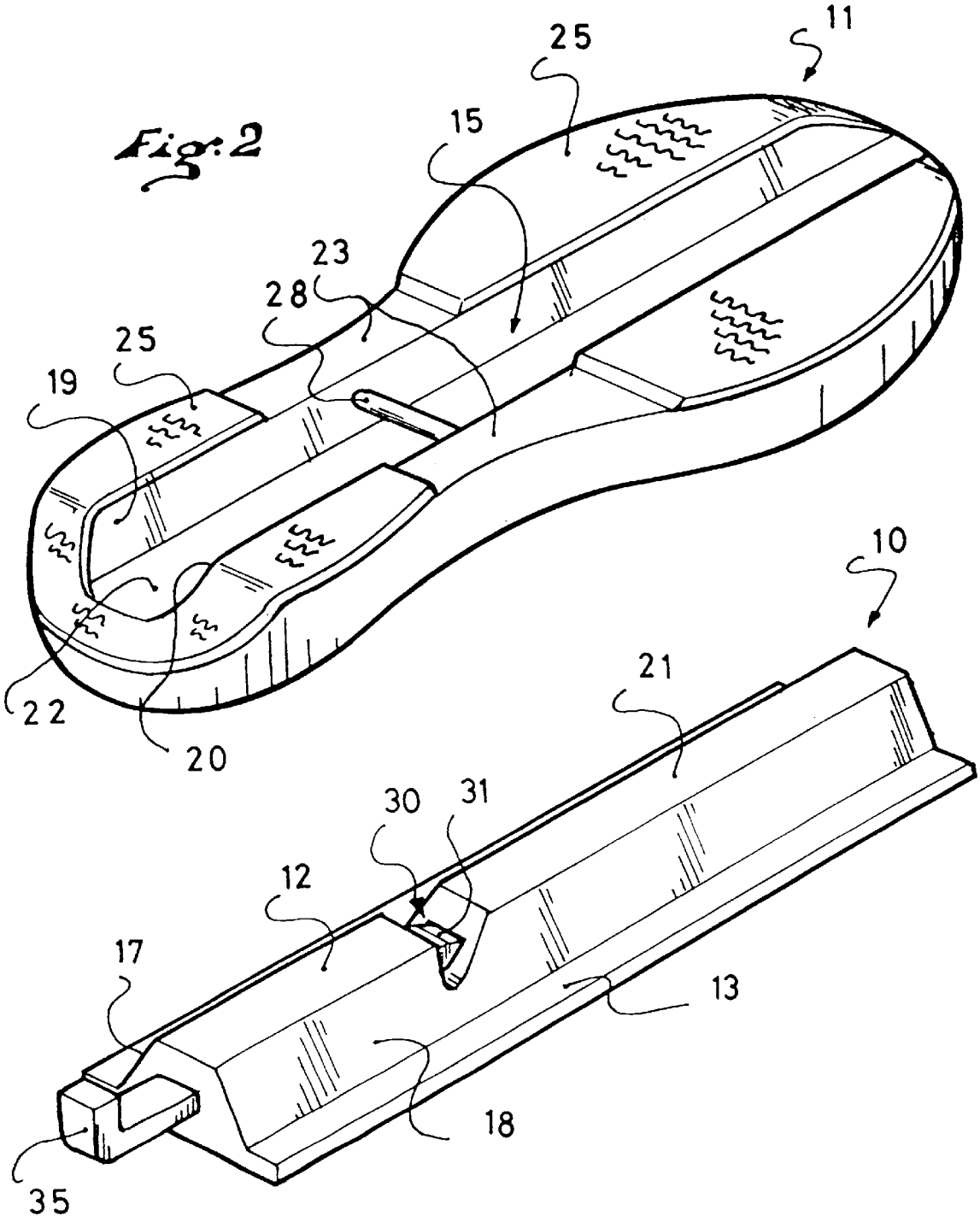
FIG. 2 is a schematic perspective view which illustrates the retention element associated with the board and the retention element associated with the boot according to a first non-limiting implementation of the invention.

FIG. 2 schematically illustrates a first implementation of the invention. This figure represents, in perspective, a retention element 10 associated with the board and a retention element 11 associated with the sole of the boot.

The retention element 10 has the shape of a rib 12 oriented along the longitudinal direction defined by the sole of the boot, having, in its lower portion, a base 13 intended for affixing to the element of the board. In a complementary fashion, the retention element 11 has a longitudinal groove 15, which, in the example illustrated, opens frontwardly and rearwardly. This is intended to facilitate the evacuation of snow and is non-limiting. The rib 12 and groove 15 have similar lengths. This length is approximately the same as the length of the boot.

Figure 3:
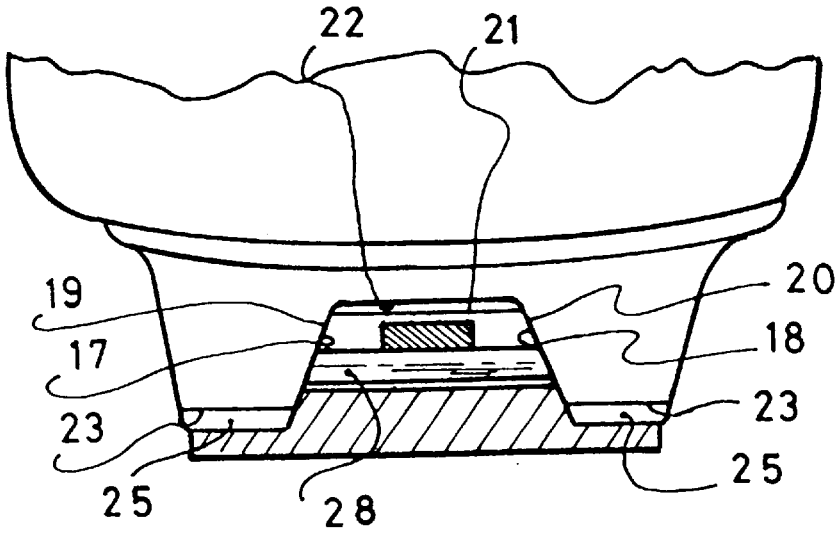
FIG. 3 is a transverse sectional view of the two elements of FIG. 2 nested on one another.
Figure 4:
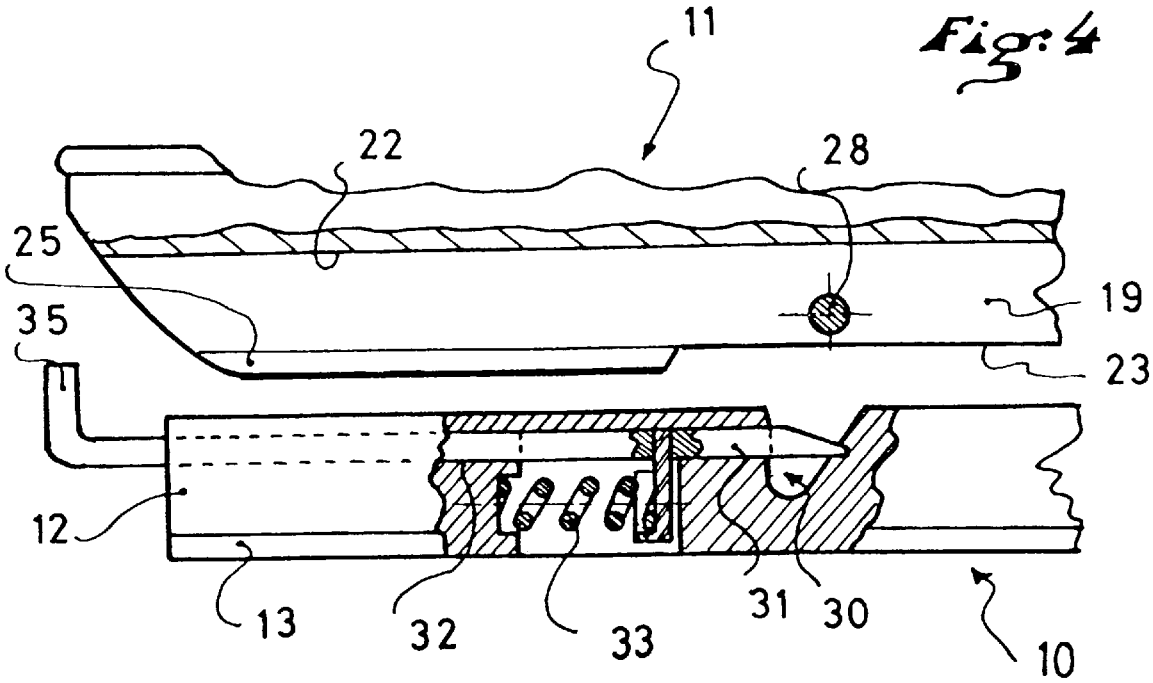
FIG. 4 is a partial longitudinal sectional view of the two superposed elements of FIG. 2 before their nesting.

FIG. 3 represents a transverse section of the element 11 nested on the element 10. As is visible, preferably, the lateral sides 17, 18 of the rib 12 are inclined with respect to a vertical plane, such that the rib is enlarged downwardly. The lateral sides 19 and 20 of the rib are also inclined in a complementary fashion such that the lateral sides of the rib and the groove form complementary engagement surfaces when the rib is nested in the groove. In this embodiment, the surfaces generally face transversely with respect to the longitudinal direction.

Preferably, the widths of the rib and groove are determined so that the adjustment and support between the rib and the groove along a vertical direction take place by relative support of their respective lateral sides.

However, this is non-limiting, and the vertical support between the two elements could also be obtained by cooperation of the top 21 of the rib with the base 22 of the groove, or even by the edges 23 of the groove with the lateral edges of the base 13, or any other appropriate means. For example, the lateral edges 23 of the groove could be equipped, at least locally, with strips or slip soles 25 of elastically deformable material which simultaneously ensure partial support of the vertical forces, a taking up of the play, and if necessary, a slight elastic play during the glide. These strips or slip soles can also be useful for walking.

The apparatus illustrated in the figures further comprises a latching mechanism for retaining the nesting of the rib and the groove. To this end, the figures represent for element 11, a transverse profile 28, forming a catch for retention of the element 11, the catch being located towards the center of the rib, and which extends between its two lateral edges towards mid-height. The profile 28 is circular, for example, taking the form of a pin or rod, but it can also be sectionally presented in any other form.

In order to receive the profile 28, the rib 12 has on its side, a notch 30 which is oriented along a transverse direction. Preferably, as is shown, the notch 30 is flared upwardly in order to facilitate guiding of the profile 28 when it is introduced.

The rib 12 further has a kind of sash bolt, i.e., a latch or jaw 31, which is movable along a longitudinal direction, and which is positioned to be capable of blocking the profile or catch 28 at the bottom of notch 30. For example, the latch is located mid-width of rib 12; it is slidably mounted in a housing or guide 32 along a longitudinal direction, and is elastically returned to the sealing position of the notch 30 by a spring 33.

A tie rod or release arm 35 or any other appropriate means, i.e., a jaw movement portion, is connected to the latch 31; in the embodiment shown in FIG. 2, the release arm is integrally connected to the latch/jaw. The release arm enables the latch to momentarily retract into the rib to release the opening of the notch 30. The release arm could also be replaced by a lateral lever or by any other appropriate means for maneuvering the latch, especially a flexible means such as a cable. As also shown in the figures, the end of the release arm 35 is engagable for manipulation to move the latch/jaw 31 into or out of engagement with the catch or rod 28. The elements that enable movement of the jaw 31, i.e., that enable movement of the structure that is engageable with the rod or profile 28, can be regarded a "jaw movement mechanism" or a "jaw movement portion". For example, the jaw movement mechanism includes the release arm 35, which extends from the jaw 31, is slidably received within the guide 32 within the rib 12, and extends outside of the guide 32 for manipulation of the jaw 31.

Advantageously, the latch 31 has an inclined upper surface which enables an automatic engagement of the profile in the notch by a vertical pressure of the profile on the tie rod/release arm. If necessary, the lower surface of the latch is slightly inclined to ensure automatic taking up of play on the profile 28. In addition, the face of the notch opposite to the latch can have an opening in which the end of the latch is engaged in a position for sealing the notch.

Under the level of the tie rod/release arm, the notch has sectional dimensions that are very close to those of the profile 28 to ensure its retention without practically any play.

The apparatus operates as follows. The element 11 associated with the boot constitutes, for example, the lower portion of the sole of a boot, which is overlaid by a shell or an appropriate upper. This shell or this upper are not represented in the various figures. The element 10 is affixed to the surface of the gliding board according to a desired orientation. The affixation is obtained by any appropriate means. Possibly, the orientation of the element 10 with respect to the median longitudinal direction 2 of the board is adjustable. Any other adjustment can also be added, especially an inclination adjustment of the boot with respect to a direction perpendicular to the board, or an adjustment of the distance separating the element 10 from the other retention element of the other boot.

When putting on the boot, the rider positions his/her boot so that it is nested on the rib 12, and the profile/rod 28 is presented at the opening of the notch 30. If necessary, he/she can facilitate this positioning by a front-to-rear tipping movement of the boot. By applying vertical pressure with the boot, the rider forces the latch 31 to open, thereby enabling the penetration, and then the latching of the profile/rod into the notch. The cooperation between the rib and the groove on the one hand, the profile/rod, the notch and the latch on the other hand, ensures a linkage between the two retention elements according to all the directions of movement. In particular, the latching mechanism, i.e., the profile/rod 28, the notch 30, and the latch 31, ensure a linkage along the vertical nesting direction and along the longitudinal direction defined by the rib.

In order to release his/her boot at will, the rider exerts a traction on the release arm 35, thus enabling the release of the profile/rod 28 from notch 30.

According to the invention, the rib and the groove which cooperate together, can have any appropriate form, and do not necessarily have a transverse section of constant dimensions along their length. In addition, the rib and/or the groove are not necessarily continuous along their principal direction.

Figure 5:
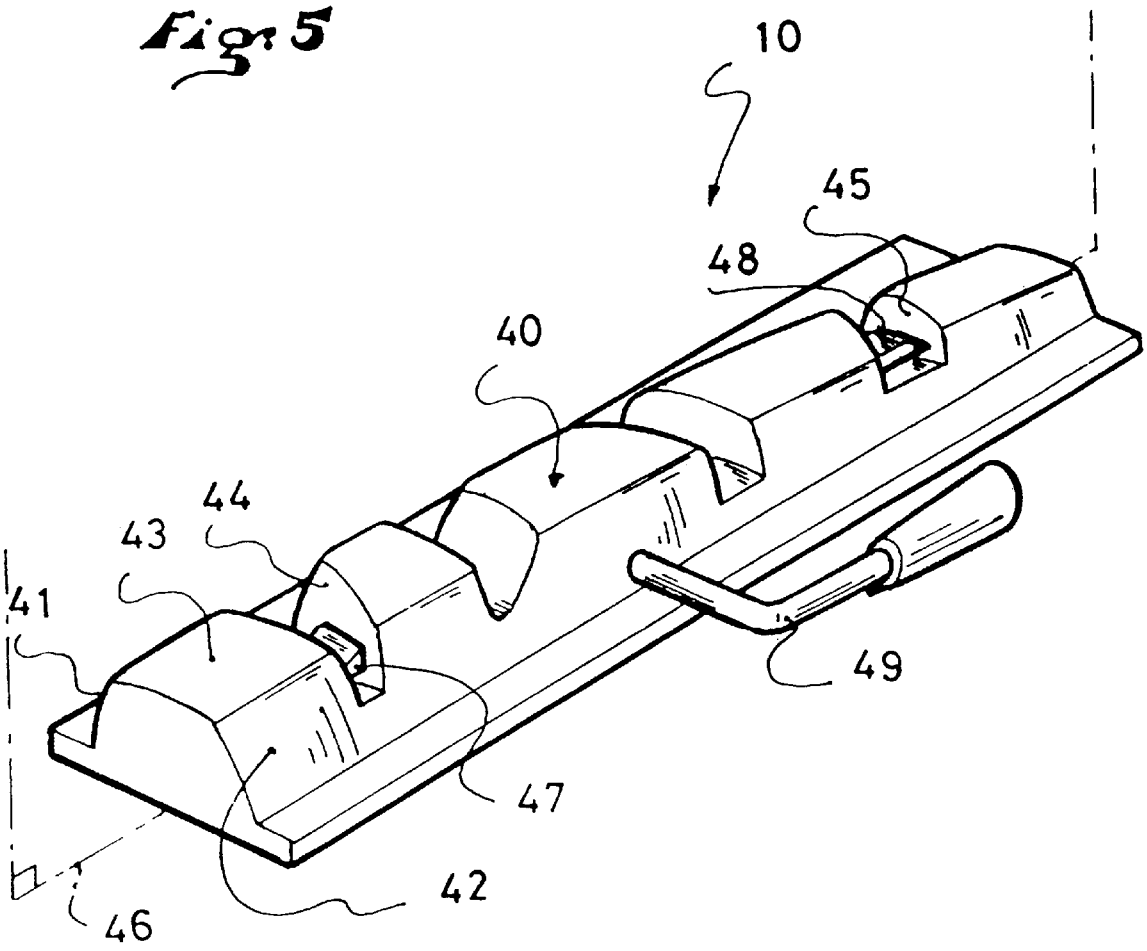
FIG. 5 represents a perspective view of a variation of the embodiment of the retention element which is associated with the board.

To illustrate this, FIG. 5 represents the retention element 10 in the form of a rib 40 of which the lateral sides 41, 42 are substantially bulged and have generally asymmetrical inclinations with respect to a median longitudinal and vertical plane as schematically shown and identified by reference numeral 46. In addition, the top 43 of the rib is inclined with respect to a horizontal plane. FIG. 5 also represents recesses 44 and 45 distributed along the length of the rib. These different variations can be implemented together or separately.

In this variation, the latching mechanism is represented with two latches or jaws 47 and 48, located at the level of the ribs 44, 45, of which the opening is controlled by a lateral lever 19. The linkage of the lever to the latches is within reach of one with ordinary skill in the art. The boot, in this case, has a hooking means or catch in two portions located at the front and the rear of the sole. These portions cooperate with the latches 47, 48 and have a constant distance whatever the length of the boot may be.

Other adaptations could also be adopted. For example, the rib, seen from the top, could have a triangular form or a sectional triangular form on at least a portion of its length. The rib could also have several secondary arms so as to form for example, a "T", a "Y" or any other appropriate form. One could also be led to locally equip the various faces of the groove and the rib with complementary forms serving as a polarizing slot, i.e., preventing the engagement of the boot on the element associated with the board in a wrong direction.

The other retention element has a groove of which the sectional dimensions are appropriate to those of the rib.

Preferably, the rib and the groove ensure an immobilization of the boot on the board about a vertical direction and along a direction transverse to the principal direction of the rib. As for the latching mechanism, it ensures a linkage along an upward vertical direction and along the principal direction of the rib. Possibly, this longitudinal linkage can be obtained by the nesting of the rib and the groove, because of their form or, for example, by transverse secondary ribs which cooperate with grooves or secondary recesses.

Figure 6:
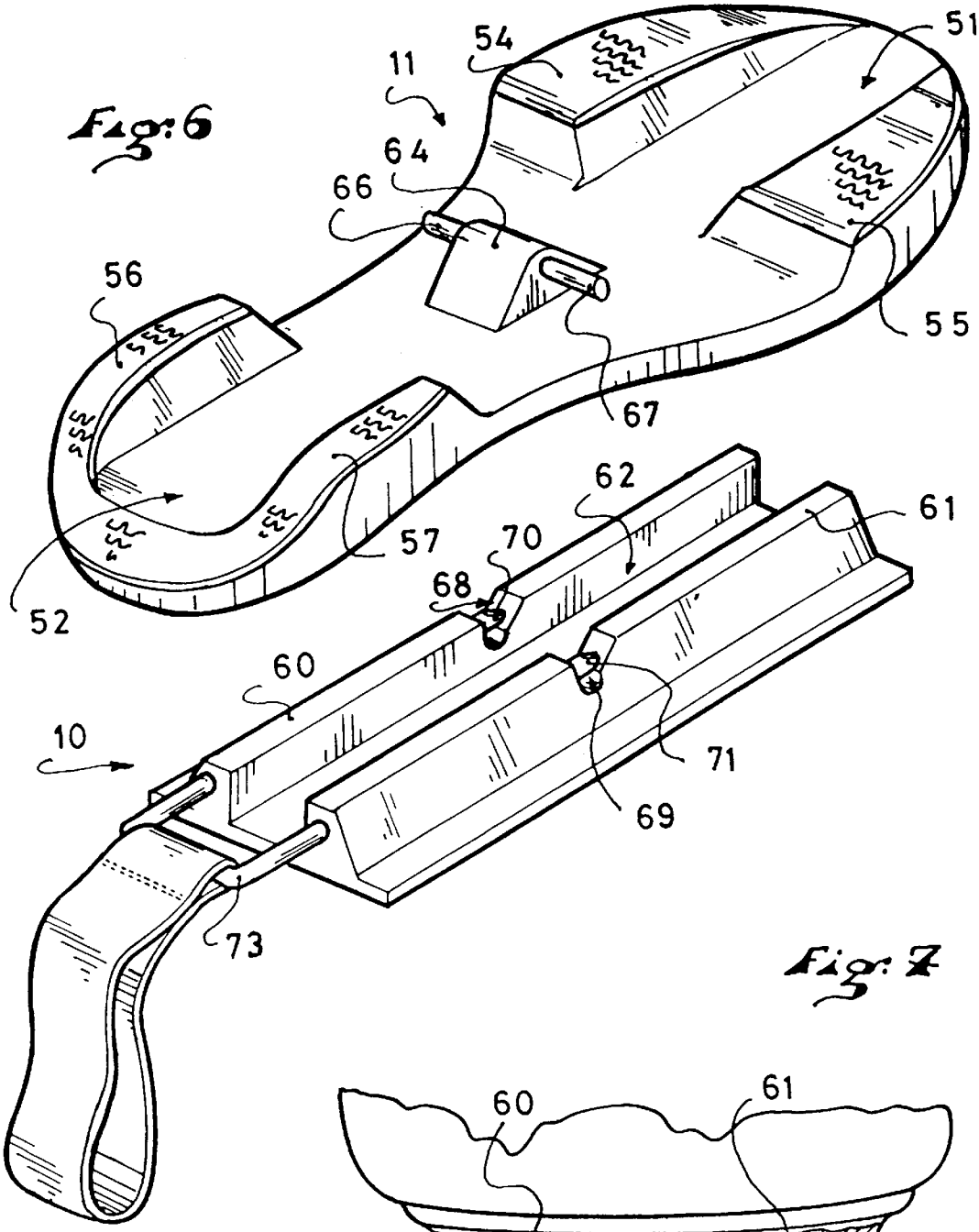
FIG. 6 is a perspective view which illustrates the retention element associated with the board and the retention element associated with the boot, according to another implementation of the invention.
Figure 7:
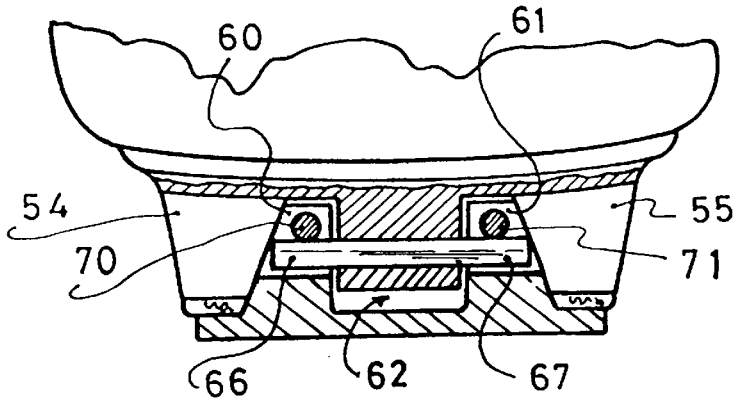
FIG. 7 is a transverse sectional view of the two elements of FIG. 6 nested on one another.

FIG. 6 represents another variation of the invention. According to this variation, the retention element 11 associated with the boot is generally presented as a groove composed of two portions 51 and 52, respectively located at the front and rear of the element in alignment with each other. The two groove portions 51 and 52 are laterally limited by lateral portions 54, 55, 56, and 57, respectively. Preferably, these edges are incurved frontwardly and rearwardly to facilitate walking. The portions 55 and 57, 54 and 56 are separated by recesses on the same side of the element.

The element 10 associated with the board is presented as a rib laterally limited by two lateral portions 60 and 61. The element 10 has a longitudinal recess 62 between the portions 60 and 61 along a transverse direction. The recess 62 opens frontwardly and rearwardly. The length of the rib is close to or less than the length of the rib formed by the lateral portions 54 to 57.

As in the preceding case, the dimensions of a transverse section of the rib formed by the longitudinal portions 60 and 61 are complementary to those of the groove formed by the portions 54 to 57 to ensure a nesting of the rib in the groove. Preferably, the sides of the rib and groove are inclined with respect to a vertical plane.

However, the form and the dimensions of a transverse section are not limiting for the invention. One can also implement variations of form and inclination of the sides such as those described hereinabove.

Furthermore, the apparatus has a latching mechanism. According to FIG. 6, element 11 has, in its central portion between the portions 51 and 52, a form 64 which extends in relief along a longitudinal direction on the bottom of the groove. This form in relief is intended to be engaged in the recess 62 of the rib, between the longitudinal portions 60 and 61. It has dimensions in a transverse section that are less than or equal to those of recess 62 to be capable of engaging in the recess. However, an adjustment of these forms between one another is not indispensable.

Laterally, the form in relief 64 has two lateral pins 66 and 67, which form a catch, extend transversely so that the distance between their ends is approximately equal to the width of the rib. Possibly, the pins 66 and 67 are the ends of a profile of which the central portion is embedded in the form in relief 64.

Complementarily, the longitudinal portions 60, 61 of the rib have two notches 68 and 69 which are intended to receive the lateral pins 66 and 67.

The latching mechanism further comprises two latches or jaws 70 and 71 which are guided into the lateral portions 60 and 61. These latches have the same function as the latch described hereinabove. They can be maneuvered by a tie rod 73. For example, the tie rod and the latches are constituted by a "U-bend" profile, of which the two lateral arms are guided inside the longitudinal portions 60 and 61. This is not limiting, and the latches could be maneuvered by a lateral lever or by any other appropriate means.

As in the preceding case, the latches can be returned to a closing position of the notches by an elastic means such as a spring, the notches 68 and 69 can be flared upwardly, and the latches can be equipped with ramps to facilitate introduction and automatic latching of the pins 66 and 67 in the notches, and if necessary, to take up the play at this level.

Figure 8:
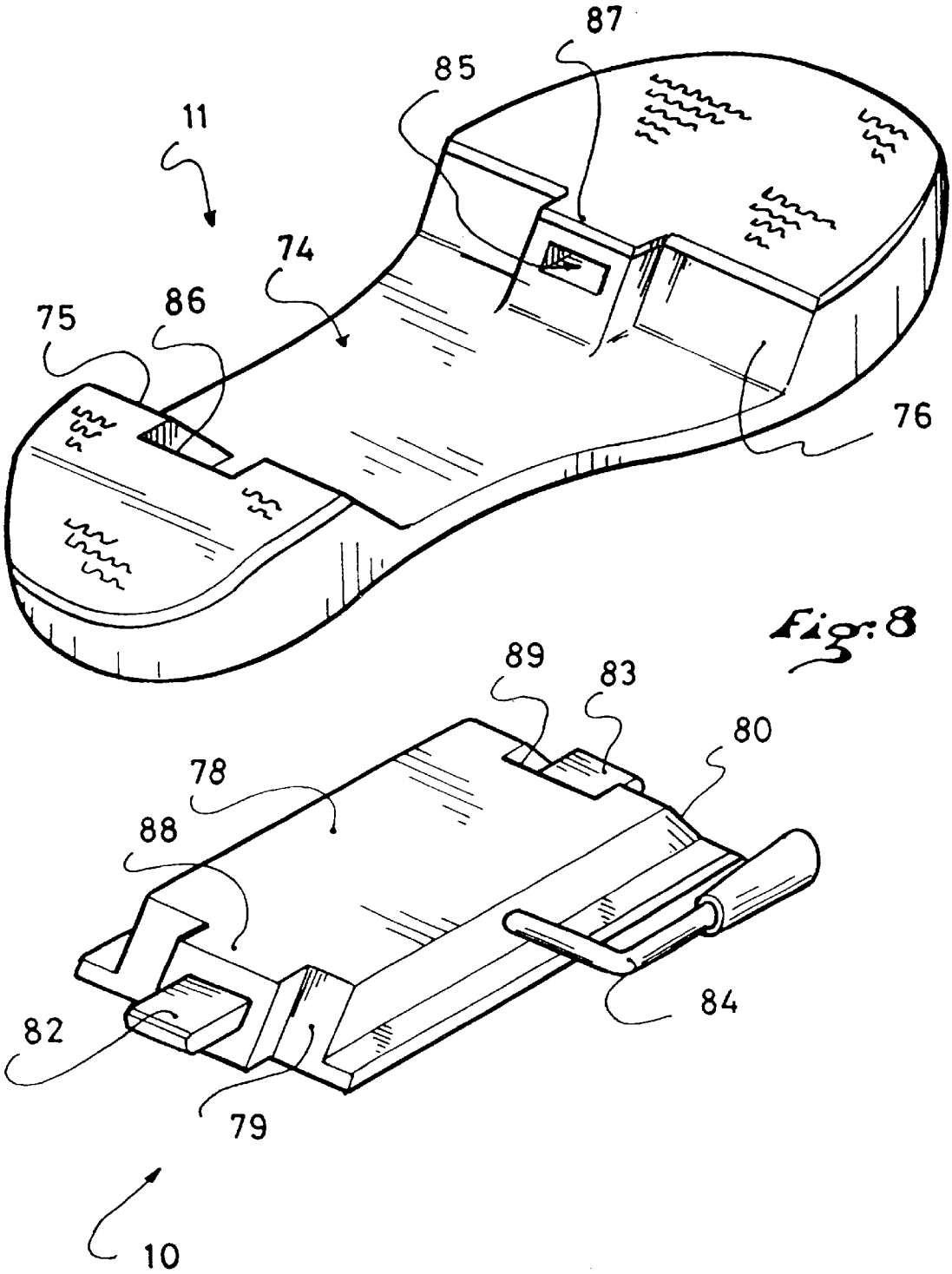
FIG. 8 represents the retention elements according to another variation of implementation of the invention.

FIG. 8 represents another variation of the invention. According to this variation, the element 11 associated with the boot is in the form of a groove 74 oriented along the width of the element 11. The groove opens laterally from each side of the sole, and it is limited at the front and the rear of the boot by two inclined sides 75 and 76. In the example illustrated, the distance between the sides 75 and 76 is greater than the width of the element 11 in its central portion.

The element 10 associated with the board has a rib 78 oriented along the width of the element. The rib 78 is limited on the front and the rear of the boot by two inclined sides 79 and 80 which are intended to cooperate with sides 75 and 76 of the groove to form complementary engagement surfaces when the rib is nested within the groove. In this embodiment, the surfaces generally face in a longitudinal direction.

The latching mechanism here comprises two elements 82 and 83 for the rib, located towards the middle of sides 79 and 80 and functioning in the manner of movable slides or jaws whose retraction into the rib is controlled by the lateral lever 84.

In the area of the inclined sides 75 and 76, the rib has housings forming a kind of catching system in which the elements 82 and 83 are intended to be engaged to retain element 11 nested on element 10. Only depression 85 of side 76, functioning as a catch, is visible in FIG. 8.

Possibly, as is represented in FIG. 8, sides 75, 76, 79 and 80 of the rib and of the groove can have complementary recessed and raised forms 86–89 which are intended to improve the retention of the nesting along the various directions, or to prevent nesting of element 11 in a wrong direction.

In addition, possibly only one of the elements 82 or 83 could be movable under the control of lever 84, the other element being fixed.

In any event, preferably, the elements 82 and 83 and the depressions 85, 86 as in the preceding case, have ramps that are intended to facilitate the automatic engagement of element 11 on element 10, and if necessary, to take up the play between both elements.

Figure 9:
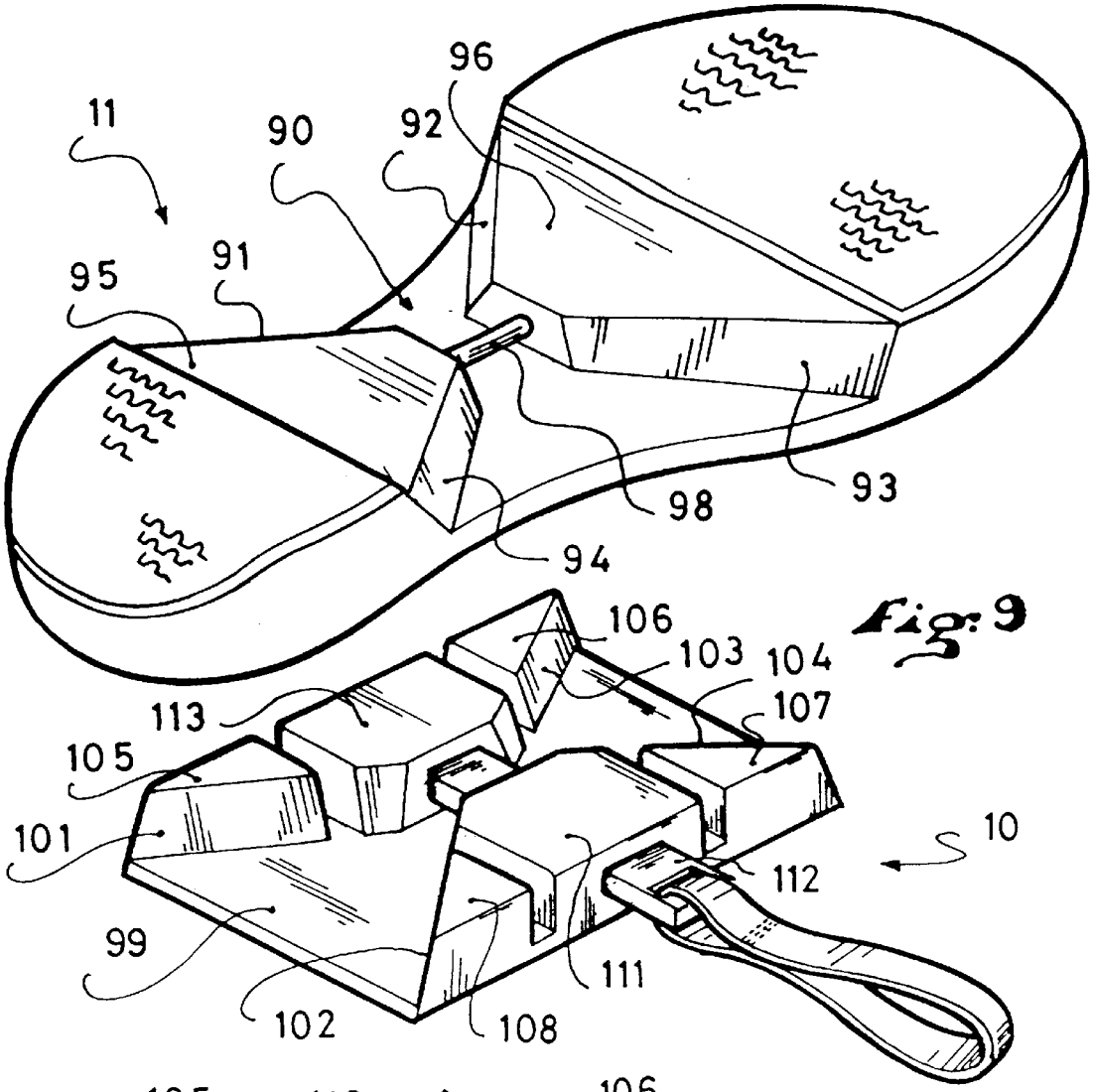
FIG. 9 also illustrates another variation of implementation of the invention.
Figure 10:
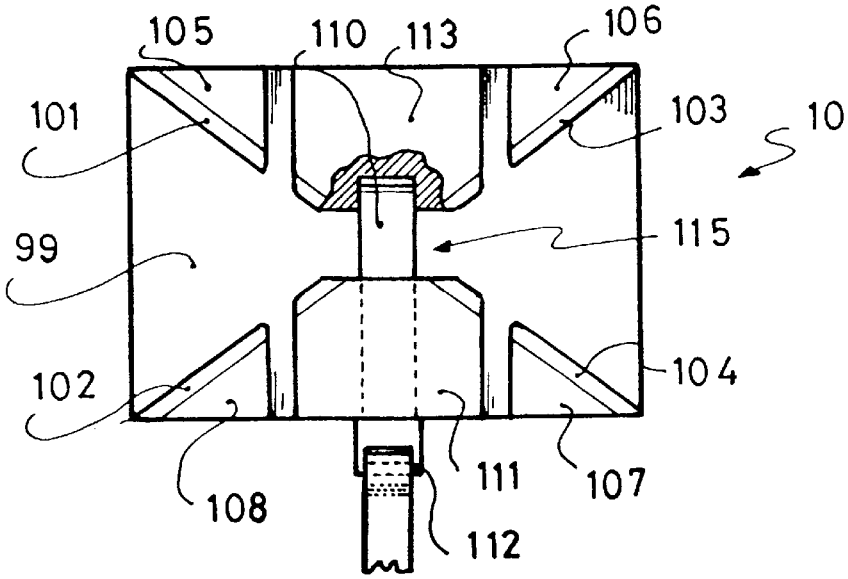
FIG. 10 is a top view of the retention element associated with the board represented in FIG. 9.

FIGS. 9 and 10 represent another variation of the implementation of the invention. According to this variation, element 11 associated with the boot has a kind of rib 90, oriented along the longitudinal direction of the sole. Here, the rib is formed by four faces 91, 92, 93, 94 converging two by two towards the median longitudinal direction of the sole and towards the central zone of the sole, in the manner of an X. In addition, according to the embodiment illustrated, rib 90 is in two parts 95 and 96, located towards the front and the rear of the boot. The two projecting parts 95 and 96 are separated by a recess, and are connected to one another by a profile 98, in the form of a pin or rod, forming a catch and being oriented along the longitudinal direction of the sole. In this variation, the profile 98 is positioned at a substantially central portion of the sole of the boot. As shown in FIG. 9, a discrete longitudinally extending space is formed between the rod 98 and the bottom of the retention element or sole 11, the space being limited longitudinally by end surfaces of the parts 95, 96.

Complementarily, element 10 associated with the board has a kind of groove 99 oriented along the longitudinal direction of the boot, of which the front and rear portions are flared. These front and rear portions are demarcated by four sides 101–104. Preferably, as is represented in FIGS. 9 and 10, the groove 99 is formed by four parts 105–108, separated from one another by recesses. Each of these parts bears a side 100–103 of the rib.

Preferably, the sides 93–96, 101–104 are inclined in the same way as in the preceding cases to form respective engagement surfaces when the rib is nested within the groove. In this embodiment, the surfaces generally face in a direction at an angle to the longitudinal direction. The orientation of the sides with respect to a longitudinal direction is non-limiting; it is, for example, on the order of 30–60°. This orientation can also be different towards the front and the rear of the boot. In addition, the figures show plane sides. This is non-limiting, and the sides could also be incurved or bulged.

The element 10 has a latching mechanism intended to cooperate with the profile 98 of the element 11 in the middle of the parts 105, 107 and 103, 104, along the longitudinal direction.

In the example illustrated, the latching mechanism comprises a latch 110 or jaw portion and an extension in the form of a release arm or slide plate, slidably guided along a transverse direction by a transverse support 111. The latch 110 can be maneuvered at the opening by a tie rod or element 112, shown in FIGS. 9 and 10 to be integrally formed with the latch 110 and the extention of the latch, which constitutes the extension of the release arm beyond the support 111 in the closed position of the latch 110 shown in FIGS. 9 and 10. Specifically, the latch 110 is inserted in the discrete space between the bottom of the rod 98 and the bottom of the retention element 11. A strap is depicted in FIGS. 9 and 10 as being attached to the element 112. As in the preceding case, an elastic means such as a spring can ensure the automatic closure of the latch.

Preferably, a second support 113 faces the first. The two supports form, therebetween, a recess 115 intended to receive the profile 98. Possibly, recess 115 is flared upwardly. In addition, the latch can have an upper ramp intended to facilitate automatic engagement of the profile, and a lower ramp intended to take up the play at this level.

According to the present variation, the latching mechanism only acts on the device associated with the boot along an upward vertical direction. The other degrees of freedom between the two elements 10 and 11 in rotation or translation are neutralized by the cooperation of the sides of the groove and the rib.

With respect to this variation, it must also be emphasized that the distinction between the rib and the groove becomes very blurred. Indeed, the element associated with the board could also be considered as having a transverse rib formed by the parts 105–108, and the element associated with the boot as having a rib oriented transversely. Therefore, the invention must be generally understood as the cooperation of two complementary forms, these forms neutralizing by their cooperation at least one portion of the relative movements between the two elements of the device, the other portion being neutralized by the latching mechanism.

Preferably, the complementary forms neutralize the rotation of the boot with respect to the board at least about a vertical axis, i.e., orthogonal to the board.

The dimensions of the forms which cooperate by nesting are non-limiting. Preferably, they fit into the contour of the sole of the boot and its projection on the board. There is no direct relationship between the length of a boot and the longitudinal dimensions of the forms, so that the element associated with the board can be used without modification or adjustment with boots of different length or volume. It is sufficient to provide the same complementary form and the same locations for the hooking and the latching means on these different boots. Preferably, at the level of the boot, the rib or the groove extends from the metatarsal zone up to the heel zone. Thus, for a defined range of boot lengths, the complementary forms of the elements associated with the board and the boot extend from the metatarsal zone up to the heel of the longest foot. However, this is non-limiting with respect to the invention.

The elements 10 and 12 associated with the gliding board and the boot are obtained in any appropriate material. For example, they are obtained in a plastic material or a light alloy.

The present description is only given as an indicative example, and other implementations of the invention could be adopted without departing from the scope thereof.

In particular, the element associated with the board could be additionally equipped with any appropriate means for adjusting its orientation in the horizontal plane with respect to axis 2 of the board, and with any other appropriate means for adjusting, if necessary, its inclination with respect to a direction perpendicular to the surface of the board, as well as its longitudinal position on the board.

In addition, it is to be understood that the invention concerns any boot intended for any type of snowboarding, that would be equipped with a retention element of the type associated with the boot.

Likewise, it is to be understood that the invention also concerns any intermediary plate that would be used as an interface between a conventional boot and a gliding board equipped with a retention element of the type described hereinabove. In this case, the intermediary plate would be equipped with a complementary retention element of the type associated with the boot.

It is also to be understood that the invention also covers a gliding board that would be equipped with a retention element integrated to its structure, or attached, of the type associated with the gliding board.

What is claimed is:

1. A snowboard binding apparatus comprising:

(a) a boot including a sole having a substantially horizontal rod attached thereto, said rod having longitudinally spaced attachment points fixedly connected to said sole, said rod being spaced from said sole to define a gap therebetween, and said rod extending in the same general direction as the longitudinal axis of said sole;

(b) a frame securable to a snowboard; and (c) a jaw device attached to said frame, said jaw device comprising:

(i) a jaw portion being movable with respect to said frame, said jaw portion of said jaw device being engagable with said rod; and (ii) a jaw movement portion extending from said jaw portion, said jaw movement portion facilitating movement of said jaw portion and extending to the side of said frame and to the side of the boot, when said boot is engaged by the jaw.

2. A snowboard binding apparatus according to claim 1, wherein:

said jaw movement portion further comprises a manipulation part for manual engagement to move said jaw portion by means of said jaw movement portion.

3. A snowboard binding apparatus according to claim 1, wherein:

said rod is positioned below a portion of said sole.

4. An intermediate plate for affixing to a snowboard for enabling retention of a boot upon a snowboard, said intermediate plate comprising:

a retention device for retention of the boot upon the snowboard, said retention device comprising one of a first retention device and a second retention device;

said first and second retention devices being complementary in shape and forming a linkage assembly, during engagement between said first retention device and said second retention device, for ensuring a linkage between the boot and the snowboard for all directions of movement;

one of said first retention device and said second retention device comprising a groove and the other of said first retention device and said second retention device comprising a rib, said rib being generally complementary in shape with said groove, and said rib being received in said groove in a nesting direction for said engagement, said rib and said groove extend within a periphery of the sole of the boot and a projection of the sole of the boot on the snowboard;

one of said first retention device and said second retention device further comprising a catch and the other of said first retention device and said second retention device further comprising (1) a latch for retaining said catch and for retaining said first retention device and said second retention device to ensure said engagement, and (2) a guide, said latch being guided for movement within said guide from an open position, for receiving said catch, to a closed position, for retaining said catch in said nesting direction against release, said latch having a manipulation portion for manual movement of said latch between said open position and said closed position.

5. A snowboard in combination with a retention device mounted on an upper surface of the snowboard for retaining a boot upon the snowboard, said retention device comprising:

a member comprising one of a first retention device and a second retention device;

said first and second retention devices being complementary in shape and forming a linkage assembly, during engagement between said first retention device and said second retention device, for ensuring a linkage between the boot and the snowboard for all directions of movement;

one of said first retention device and said second retention device comprising a groove and the other of said first retention device and said second retention device comprising a rib, said rib being generally complementary in shape with said groove, and said rib being received in said groove in a nesting direction for said engagement, said rib and said groove extend within a periphery of the sole of the boot and a projection of the sole of the boot on the snowboard;

one of said first retention device and said second retention device further comprising a catch and the other of said first retention device and said second retention device further comprising (1) a latch for retaining said catch and for retaining said first retention device and said second retention device to ensure said engagement, and (2) a guide, said latch being guided for movement within said guide from an open position, for receiving said catch, to a closed position, for retaining said catch in said nesting direction against release, said latch having a manipulation portion for manual movement of said latch between said open position and said closed position.

6. A snowboard retention apparatus for a boot to be mounted on a snowboard, said apparatus comprising:

a first retention device adapted to be affixed to the snowboard and a second retention device adapted to be affixed to the boot, said first and second retention devices being complementary and forming a linkage assembly, during engagement between said first retention device and said second retention device, and located to ensure an opposition of relative movement between the boot and the snowboard in all directions;

one of said first retention device and said second retention device comprising a groove and the other of said first retention device and said second retention device comprising a rib, said rib generally complementary in shape with said groove, said rib and said groove having complementary fixed lateral surfaces for engagement to oppose relative lateral translational movement of said rib and said groove, and said rib being received in said groove in a nesting direction for said engagement, said rib and said groove extending along a longitudinal direction a predetermined length;

one of said first retention device and said second retention device further comprising a catch and the other of said first retention device and said second retention device further comprising (1) a latch for retaining said catch and for retaining said first retention device and said second retention device to ensure said engagement, and (2) a guide, said latch and said catch being located generally centrally along said predetermined length, said latch being guided for movement within said guide from an open position, for receiving said catch, to a closed position, for retaining said catch in said nesting direction against release, said latch having a manipulation portion for manual movement of said latch between said open position and said closed position.

7. A snowboarding boot for retention on a snowboard, said boot comprising:

a sole, said sole comprising a retention device for retention of the boot upon the snowboard, said retention device comprising one of a first retention device and a second retention device;

said first and second retention devices being complementary in shape and forming a linkage assembly, during engagement between said first retention device and said second retention device, for ensuring a linkage between the boot and the snowboard for all directions of movement;

one of said first retention device and said second retention device comprising a groove and the other of said first retention device and said second retention device comprising a rib, said rib being generally complementary in shape with said groove, and said rib being received in said groove in a nesting direction for said engagement, said rib and said groove extend within a periphery of the sole of the boot and a projection of the sole of the boot on the snowboard;

one of said first retention device and said second retention device further comprising a catch and the other of said first retention device and said second retention device further comprising (1) a latch for retaining said catch and for retaining said first retention device and said second retention device to ensure said engagement, and (2) a guide, said latch being guided for movement within said guide from an open position, for receiving said catch, to a closed position, for retaining said catch in said nesting direction against release, said latch having a manipulation portion for manual movement of said latch between said open position and said closed position.

* * * * *